US007595486B2

(12) United States Patent
Franzen

(10) Patent No.: US 7,595,486 B2
(45) Date of Patent: Sep. 29, 2009

(54) RF MULTIPOLE ION GUIDES FOR BROAD MASS RANGE

(76) Inventor: Jochen Franzen, Helmer 17, 28359 Bremen (DE)

( * ) Notice: Subject to any disclaimer, the term of this patent is extended or adjusted under 35 U.S.C. 154(b) by 266 days.

(21) Appl. No.: 11/691,166

(22) Filed: Mar. 26, 2007

(65) Prior Publication Data

US 2007/0284524 A1 Dec. 13, 2007

(30) Foreign Application Priority Data

Apr. 6, 2006 (DE) ..... 10 2006 016 259

(51) Int. Cl.
*H01J 49/04* (2006.01)

(52) U.S. Cl. ..... 250/288; 250/281; 250/282; 250/286; 250/396 R

(58) Field of Classification Search ..... None
See application file for complete search history.

(56) References Cited

U.S. PATENT DOCUMENTS 5,572,035 A 11/1996 Franzen
7,189,965 B2 3/2007 Franzen
7,391,021 B2 * 6/2008 Stoermer et al. ..... 250/292

FOREIGN PATENT DOCUMENTS

| | | | |
|---|---|---|---|
| DE | 103 24 839 | A1 | 3/2004 |
| GB | 2 392 005 | A | 2/2004 |
| WO | WO 01/13100 | A2 | 2/2001 |
| WO | WO 2005/034169 | A1 | 4/2005 |

* cited by examiner

*Primary Examiner*—David A. Vanore
(74) *Attorney, Agent, or Firm*—Law Offices of Paul E. Kudrika

(57) ABSTRACT

In a multipole rod ion guide system operated with RF voltages to collect or transmit ions, the inhomogeneity of the electric RF fields is increased in front of the ion guide rods by forming the rod surfaces from a plurality of spaced electrodes. The inhomogeneous fields produced by the plurality of electrodes increases the mass range over which the ions are guided effectively while still maintaining a pseudopotential minimum which is as well defined as possible close to the axis. Particularly favorable ion guides of this type make it possible to apply an axial DC field to the guide system for the active transport of the ions.

7 Claims, 5 Drawing Sheets

RF MULTIPOLE ION GUIDES FOR BROAD MASS RANGE

BACKGROUND

The invention relates to multipole systems which are operated with RF voltages and are used as ion guides to collect or transmit ions.

RF multipole rod systems have been used as ion guides for more than twenty years. Particularly well known are RF quadrupole rod systems with four pole rods according to Wolfgang Paul, but hexapole and octopole rod systems are also quite popular. The rod systems can be made of round pole rods but hyperbolic rods are more favorable, especially for quadrupole rod systems.

The multipole systems are based on the effect of so-called "pseudopotentials", which are produced in inhomogeneous alternating fields. Both the alternating field at the tip of a wire, whose field intensity decreases with $1/r^2$, as is well known, and also the alternating field around a long wire, which decreases with 1/r, reflect both positively and negatively charged particles. This occurs because the particle oscillates in the alternating field of the wire. Irrespective of its charge, the particle experiences maximum repulsion from the wire precisely when it is at the point of its oscillation which is closest to the wire, i.e. at the point where the field intensity is highest; the particle experiences maximum attraction when it is furthest away, i.e. at the point of its oscillation where the field intensity is lowest. Integration over time therefore gives a repulsion of the particle away from the tip. The repulsive field obtained by integration over time can be described by the "pseudopotential" which is proportional to the square of the alternating field intensity. The derivative of this gives an electric "pseudo force field". For the tip of the wire, the repulsive pseudopotential decreases at $1/r^4$; for the long wire it decreases outward at $1/r^2$, but in both cases it is still inversely proportional to the mass of the ions and the square of the frequency.

If the two opposite phases of an RF voltage are applied to two neighboring wire tips, then both tips repel charged particles independently. Their combined effect is amplified. The alternating field of this dipole already decreases at more than $1/r^2$, however. If one arranges a complete two-dimensional field of wire tips where different phases of the RF voltage are applied to neighboring tips in both dimensional directions, a surface is obtained which repels particles of both polarities at short range and hence reflects them. This is not a specular but a diffuse reflection. In front of this field, at a distance which is large compared to the separation of the tips, there is almost no field at all.

The field produced by long, parallel wires also forms an ion reflector if every other wire is fed one phase of the RF voltage and the remaining wires the other phase. A mixture of tips and wires, similar to a mesh, is also possible, in which case there is a wire tip in each cell of the mesh.

The surface made up of parallel wires also produces an alternating field which is effective only a short distance into the space outside the surface. In the longitudinal direction of the wires, the reflection is specular; in the transverse direction it is diffuse. With an infinitely extended surface, the field decreases roughly exponentially in the direction perpendicular to the surface. If there is a field intensity F on the surface of a wire grid, whereby the radius of the wires is one tenth of the separation of the wires, then at a distance of one wire separation, the field intensity is only 5% of F; at a distance of two wire separations it is only 0.2% of the field intensity F; at a distance of three wire separations it is only 0.009% of the field intensity F. The repulsive pseudopotential, which is proportional to the square of this field intensity, thus decreases even more rapidly.

The reflective effect that RF voltages have on bipolar grids made of tips or wires has already been described in U.S. Pat. No. 5,572,035A (J. Franzen). The multipole rod systems are limiting cases of reflective walls based on parallel wires where the wires form a cylindrical wall.

If one considers the pseudopotential in the cross section of a quadrupole rod system, it has a minimum in the axis of the rod system. The pseudopotential increases quadratically from the axis outward on all sides. The rotationally symmetric parabolic minimum of the pseudopotential in the cross section forms a potential channel along the axis of the rod system. If a rod system such as this is filled with a collision gas at a pressure between 0.01 and 1 Pascal, injected ions give up most of their kinetic energy as a result of collisions with this gas and collect with only thermal energy in this potential channel along the axis. This effect is also observed when the ions are in slow flight. This process, which has been known since the early 1980s, is now termed "collisional focusing".

Collisional focusing is now of significant importance for most modern mass spectrometers. The injection of ions into a subsequent stage of a mass spectrometer, for example into a subsequent ion guide or ion analyzer, almost always depends on the cross section of the ion beam. A very fine beam cross section, as is produced by collision focusing, is almost always advantageous. This applies for injection into a quadrupole mass filter just as it does for injection into an ion trap, and in particular for injection into a time-of-flight mass spectrometer with orthogonal ion outpulsing into the flight path.

The rod systems used to guide ions are generally very long and thin so that they can concentrate the ions in a region with a very small diameter. They can then be advantageously operated with low RF voltages and form a good starting point for the subsequent ion-optical imaging of the ions. The free cylindrical interior is often only around 2 to 4 millimeters in diameter, the rods are less than one millimeter thick, and the system is 2 to 25 centimeters long. The term "long" pole rods here should be taken to mean pole rods which are longer than the separation between opposite pole rods.

The term "mass" here always refers to the "mass-to-charge ratio" or "charge-related mass" m/z, which alone is of importance in mass spectrometry, and not simply to the "physical mass" m. The number z indicates the number of elementary charges, i.e. the number of excess electrons or protons of the ion, which act externally as the ion charge. All mass spectrometers without exception can measure only the mass-to-charge ratio or charge-related mass m/z, not the physical mass m itself. The mass-to-charge ratio is the mass fraction per elementary charge of the ion.

It is known that all RF rod systems exhibit a lower mass limit for the storage or transmission of ions. In quadrupole rod systems, this mass limit is sharply defined, less so with higher multipoles. The mass limit is a function of the frequency and the amplitude of the RF voltage. It is inversely proportional to the square of the frequency and proportional to the amplitude. For a specified frequency it is therefore the amplitude of the RF voltage which determines the lower mass limit. If light ions are also to be transmitted without losses, the RF voltage must have a small amplitude. The lower mass limit is given by the stability zone of the Mathieu differential equation for the motion of the ions in RF quadrupole fields. A pseudopotential cannot form for light ions because they are accelerated in just one half cycle of the RF voltage to such a degree that they are either propelled out of the storage field in a single half cycle or experience this propulsion by being excited in several half cycles.

The fact that quadrupole rod systems have an upper mass limit is less well known. The Mathieu differential equations state only that the restoring forces of the pseudopotential are smaller for heavy ions than for light ions: The restoring forces are proportional to the inverse of the mass of the ion. This means that light ions collect in the axis because the focusing pseudopotential is stronger for them, and heavier ions can only gather outside the axis, kept at a distance from the lighter ions by Coulomb repulsion.

With a quadrupole rod system that operates under high-vacuum conditions, the upper mass limit only makes itself felt during injection and when the rod system is overfilled. Even if the injection is only slightly oblique, the weak pseudopotential for heavy ions can no longer deflect them back to the axis; they hit the rods and are eliminated. If the system is overfilled, the space charge drives the heavy ions right up to the rods. If the quadrupole rod system is filled with a collision gas, there are two further components: the thermal diffusion brought about by gas collisions, which can drive heavy ions right up to the pole rods because of the weak pseudopotential opposing field, and the collision cascades in the case of ions injected with higher energy, whose lateral angles of deflection can randomly add up so that the ions crash into the pole rods. Both effects result in considerable losses of heavy ions. Furthermore, heavy ions are discriminated again during ejection from the ion guide because they are not in the axis.

The upper mass limit does not have a sharp cut off, but it does attenuate the intensity of heavy ions to such a degree that they can no longer be readily detected by a mass spectrometer. The rule of thumb for a quadrupole rod system is that when an ion mixture is injected, the ions whose mass is more than twenty times the lower mass limit are greatly attenuated by losses and can no longer be readily measured.

The existence of the upper mass limit is particularly inconvenient in the field of peptide analysis in proteomics. The aim here is to measure both individual amino acid ions, the so-called "immonium ions" in the range between 50 and 180 Daltons, and the mass range of the so-called digest peptides up to around 5,000 Daltons. But if the lower mass limit is set to around 50 Daltons, this results in an upper mass limit of around 1,000 Daltons, which is quite unacceptable for this type of analysis. This means that time-of-flight mass spectrometers with orthogonal ion injection, which are employed particularly because of the high mass range, cannot be used in connection with quadrupole ion guides of the present art.

One solution is to use hexapole or octopole rod systems. These have more favorable pseudopotential distributions for heavier ions with a steeper potential increase outside the axis in front of the pole rods, but the bottom of the potential well is flat close to the axis. The well defined pseudopotential minimum which exists in the axis of a quadrupole field does not exist here. The ions do not collect as accurately in the axis of these systems and therefore cannot be injected as favorably into subsequent systems. The collision focusing is weaker. The operation of time-of-flight mass spectrometers with orthogonal ion injection suffers from a poorer resolution because the required fine cross section of the ion beam can no longer be achieved.

With octopole rod systems, in particular, heavy loading with ions can lead to the heavier ions collecting way outside the axis, close to the rods because they are driven there by the space charge. This charge-dependent distribution of the ions in the interior is very unfavorable. It can even occur when there are no light ions at all in the ion mixture; the pure Coulomb repulsion between the heavy ions is sufficient. The ions collect on the surface of a cylinder; there is no collision focusing at all if a threshold ion density is exceeded.

SUMMARY

In accordance with the principles of the invention, a more inhomogeneous field distribution is generated in front of the pole rods of a multipole ion guide, preferably a quadrupole RF ion guide, by giving the pole rods a structured surface. In one embodiment, this can be achieved by using complex structures, termed "pole electrode systems" here, instead of the solid pole rods.

The surfaces of the pole electrode systems may consist of grids of structural elements; and neighboring structural elements can each be fed with different RF voltages so that a near field is created in front of each pole electrode system, said near field being formed from the strongly inhomogeneous electric RF dipole fields between the structural elements, and also a far field, which is produced by the RF voltages averaged over the surfaces of the structural elements. This grid can be made of very fine punctiform structural elements, in which case it forms a "point grid", or of one-dimensionally elongated linear structural elements, creating a "line grid".

The far field corresponds exactly to the field which is generated by the smooth pole rods of prior art. With four pole electrode systems this creates a corresponding quadrupole field.

The grids of the structural elements on the pole electrode systems can also particularly be "multipole grids", which means that neighboring structural elements of each pole electrode system belong to different structural element arrays; that the structural elements of a structural element array are electrically connected; and that the different structural element arrays are each separately fed with RF voltages. In particular, there can be precisely two such structural element arrays for every pole electrode system, resulting in a "bipolar grid".

A far field can exist only if the applied RF voltages do not fully balance each other out in the near field, but instead one of the applied RF voltages predominates and can act at a distance. A non-vanishing far field is generated across a bipolar grid, for example, either by applying two RF voltages with the same frequency but different amplitudes, or by using a mixture of RF voltages with different frequencies which do not all balance each other out in the near field, resulting in neutralization, or by virtue of the fact that the structural elements are different sizes or different distances from a virtual covering surface of the pole electrode system. There can also be a mixture of different types of RF voltages and structural elements. It is also particularly possible to use, for example, two RF voltages which have the same amplitude and frequency but whose phase difference is something other than 180°, in which case only some of the amplitudes in the dipolar field of the asymmetrically arranged structural element arrays is balanced out, and the rest remains for the far field.

Thus, according to one embodiment of the invention the smooth rods of current multipole rod systems are replaced with pole electrode systems whose surfaces have a structure with closely packed zero-dimensional (tip-shaped) or one-dimensional (wire-shaped or edge-shaped) structural elements, the edges or tips reproducing the current shape of the smooth surface of the rods. Connecting the structural elements to RF voltages generates a dipole field in the near region, and further away a far field similar to that produced by the rods currently used. In the near region in front of the virtually generated surface the structural elements thus have an alternating electric near field which is more inhomogeneous than it would be if it were formed by the smooth surface of the rods. Heavy ions which approach the pole electrode systems can thus be more strongly driven back while, close to the axis, a multipole field of the current type with a low lower mass limit can be formed.

In accordance with another embodiment of the invention, solid pole rods are used where the surfaces of the rods are reshaped to form a field of edges or tips with enclosed indentations produced, for example, by milling grooves. Here, as well, the alternating fields which are generated on the edges or tips are more inhomogeneous than they would be the case on smooth surfaces. It is thus possible to produce quadrupole systems whose upper mass limit is 30 to 40 times the lower mass threshold.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
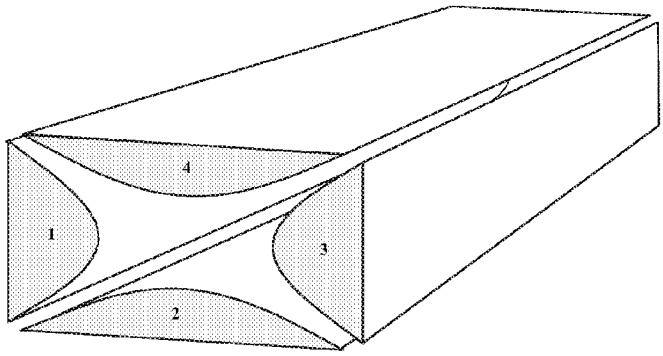
FIG. 1 (Prior Art)
FIG. 1 shows a quadrupole ion guide according to the prior art with four hyperbolic pole rods (1, 2, 3, 4).
Figure 2:
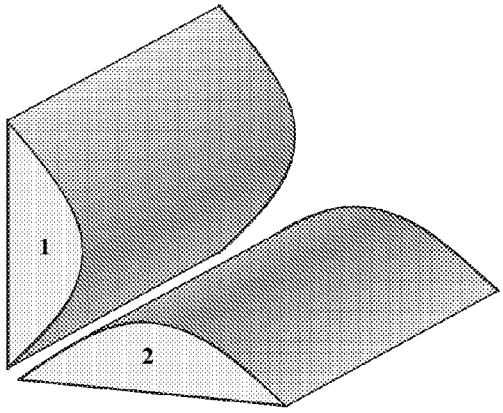
FIG. 2 (Prior Art)
FIG. 2 shows only the two pole rods (1) and (2) of the quadrupole ion guide in FIG. 1 so that the hyperbolic surfaces are visible.
Figure 3:
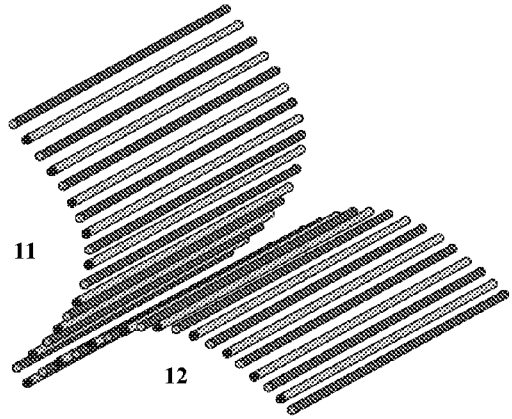
In FIG. 3 the hyperbolic surfaces of the pole rods in FIG. 2 are replaced by elongated electrodes in the form of wires, creating the pole electrode systems (11) and (12) instead of the pole rods. The electrode wires here are fixed parallel to the axis of the ion guide.
Figure 5:
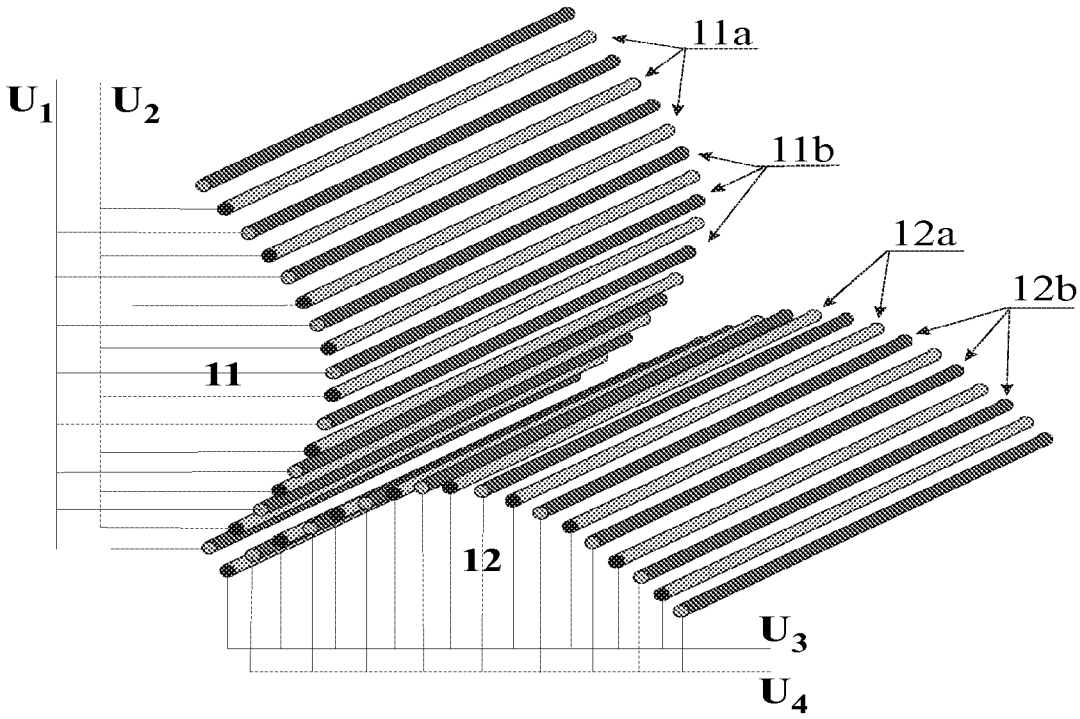
FIG. 5 illustrates how the pole electrode systems in FIG. 3 are connected with the voltages $U_1$ to $U_4$. The pole electrode system (11) has two electrode arrays (11*a*) and (11*b*), each at a voltage of $U_1$ or $U_2$ and which form a bipolar grid. The pole electrode system (12) is also configured as a bipolar grid.
Figure 6:
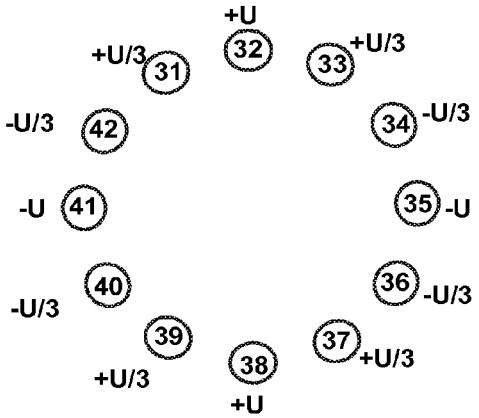
FIG. 6 illustrates a system of round rods arranged as a dodecapole. A special configuration generates a quadrupole field rather than a dodecapole field, the rod groups (31, 32, 33), (34, 35, 36), (37, 38, 39) and (40, 41, 42) each representing a pole electrode system as defined in this invention. Between any two neighboring pole rods there is always the alternating voltage difference 2U/3, which generates the dipole fields. The rod pairs (32, 38) with voltage +U and (35, 41) with voltage −U supply the main part of the quadrupole field.
Figure 7:
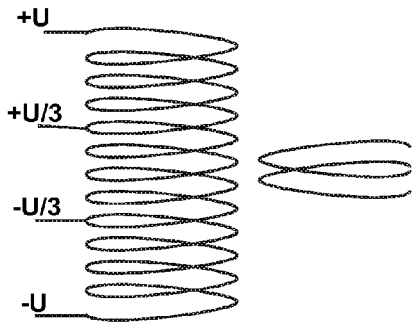
FIG. 7 illustrates how the voltages for the rod system in FIG. 6 can be generated by a single secondary winding of an RF transformer.

A simple but strongly effective embodiment of the invention consists in replacing each of the smooth pole rods used hitherto by a bipolar wire grid and reproducing the surfaces of the pole rods with the grid, as shown in FIGS. 3 and 5. The electrode wires here are fixed parallel to the axis of the ion guide. The wires of the pole electrode system can, of course, also be replaced by a system of lamellae made of metal electrode sheets. A system of lamellae leads to the same electric fields in front of the surface of the pole electrode system. The disadvantage of a system of lamellae is that it has a larger electrical capacitance; it therefore requires a more powerful RF generator. Its advantage is that the lamellae are easy to fix mechanically, with spacing insulators, for example. With a system of wires, on the other hand, it is a little difficult to fix the wires mechanically without creating insulating surfaces which can be charged by impinging ions.

A bipolar grid (11) like the one in FIG. 5 can generally be configured with the voltages $U_1=A_1 \cos(\omega_1 t)+A_3 \cos(\omega_3 t)$ and $U_2=A_2 \cos(\omega_2 t)-A_3 \cos(\omega_3 t)$. The two voltages of opposite polarity $\pm A_3 \cos(\omega_3 t)$ balance each other out completely in the near field region and thus form the dipolar near field. The quadrupole far field between the four pole electrode systems is formed by the voltage component $A_1 \cos(\omega_1 t)+A_2 \cos(\omega_2 t)$, it being preferable for the two frequencies $\omega_1$ and $\omega_2$ to be the same. The amplitude $A_2$ can also be set at zero. The frequency $\omega_3$ for the dipole field must not be the same as the frequency of the far field. It can be favorable for the frequency $\omega_3$ of the dipolar near field to be lower than the frequency $\omega_1$ of the far field in order to generate a more repulsive force for heavy ions close to the pole electrode systems.

Figure 11:
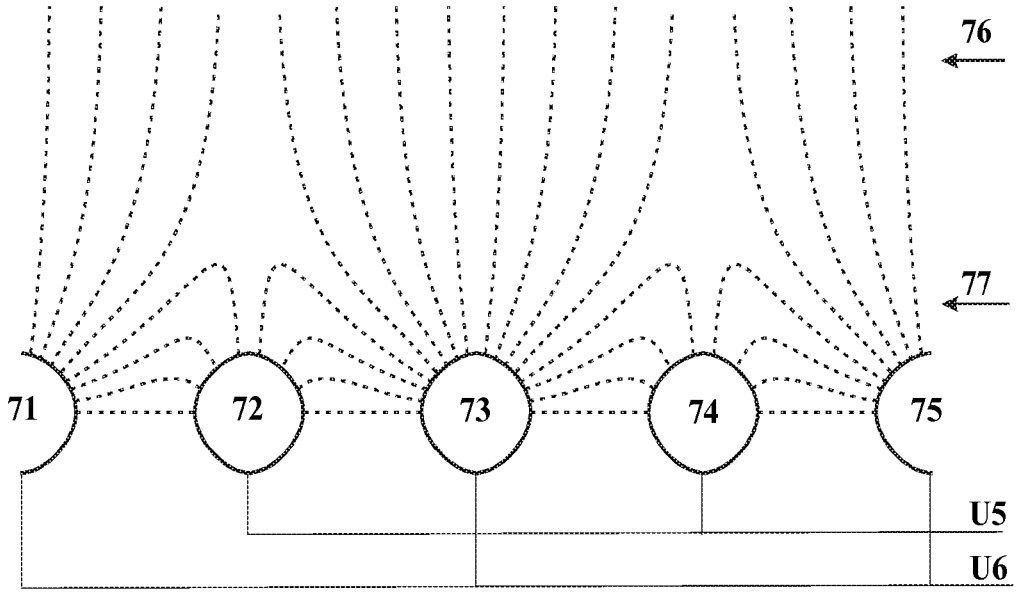
FIG. 11 illustrates the electric field lines of a bipolar wire grid (71-75) that is fed with the two RF voltages U5=+A $\cos(\omega t)$ and U6=−(A/2) $\cos(\omega t)$. A far field (76) is formed which corresponds to all wires being fed with +(A/2) $\cos(\omega t)$, with a dipole field superimposed in the near field region (77).

The electric field in front of the bipolar grid (71-75), which roughly corresponds to a section of the grid in FIG. 5, is shown in FIG. 11 for a specific voltage configuration. The two voltages here are U5=$A_1 \cos(\omega_1 t)$ and U6=$-(A_1/2) \cos(\omega_1 t)$. The voltage components $\pm(A_1/2) \cos(\omega_1 t)$ from the voltages U5 and U6 in the dipolar near field balance each other out, while the voltage component $(A_1/2) \cos(\omega_1 t)$ from U5 is left for the far field. A strongly inhomogeneous field is formed in front of each of the wire electrodes (71-75), said field driving back the heavy ions according to the invention.

Figure 4:
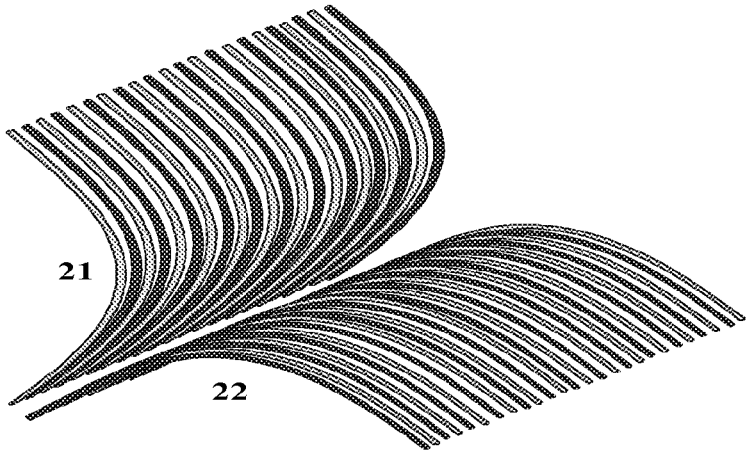
FIG. 4 illustrates the situation when the rod surfaces are replaced by a system of electrode wires arranged at right angles to the axis of the ion guide. This creates the pole electrode systems (21) and (22).

Very similar near and far fields can be created in front of the electrode structure shown in FIG. 4. In this case, the wire-shaped electrodes of the pole electrode grid are arranged at right angles to the axis of the ion guide. Here too, the electrode wires can be designed as electrode lamellae. A special configuration of the individual electrodes even makes it possible to superimpose an axial DC field on the RF field here, enabling the ions to be actively driven through the ion guide. An active forward drive of this type is already familiar from the above-cited U.S. Pat. No. 5,572,035 A for ring electrode systems, and from German Patent Publication DE 10 2004 048 496.1 (equivalent to British Patent Publication GB 2 422 051 A) for diaphragm stacks with non-round apertures. It is also possible to create quadrupole electric RF fields in these diaphragm stacks.

The two grid-like structural element arrays of pole electrode systems such as those shown in FIGS. 3, 4 and 5 are relatively easy to produce if the solid rod is replaced by an electrode structure made of individual lamellar metal electrodes which are stacked in the longitudinal or transverse direction and isolated from each other. If the lamellar electrodes have smooth edges, a system of edges is formed, but if the edges are split up into individual spikes, they form a system of tips. To reduce the electrical capacitance, the lamellar metal electrodes can be arranged in a filigree structure so that only small pieces of the surface of any two electrodes are next to each other. With an electrode stack whose sheet electrodes are arranged transversely, it is also easily possible to superimpose an electric DC field in the axial direction, as indicated above.

Figure 8:
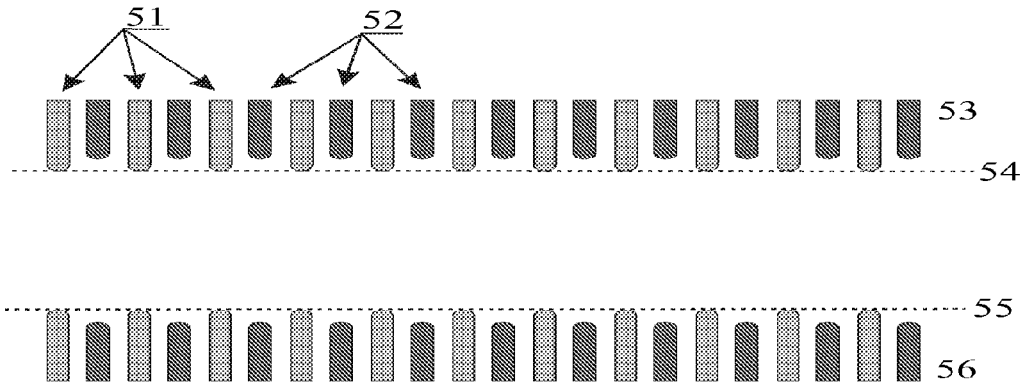
FIG. 8 represents two opposed pole electrode systems (53) and (56) constructed of lamellar electrodes. Each system of lamellae comprises two electrode arrays (51) and (52) which create a type of bipolar grid, but the electrodes of one electrode array (52) do not extend as far as the virtually generated surface (54). The same is true for the virtual surface (55). Due to this geometric asymmetry, the influence of the electrode array (51) predominates if two RF voltages of opposite polarity but the same amplitude are applied across the two electrode arrays.

A non-vanishing far field in front of a bipolar grid can be generated by two different amplitudes of the RF voltages so that, at a distance from the surface of the electrode structure, one of the two RF voltages predominates. It is also possible to apply two equal RF voltages of opposite polarity to the two arrays of an electrode structure if the structural elements of one array extend less far toward the surface of the electrode structure, as shown schematically in FIG. 8. Here, as well, the field of one RF voltage predominates at a distance in front of the surface, namely the field of the RF voltage across the protruding electrode array (51), even if it is attenuated. It is then possible, for example, to create a relatively weak quadrupole alternating electric field with a very low lower mass limit in the interior of a system comprising four such electrode structures; but close to the surface of each electrode structure, the field increases to a strongly reflecting pseudopotential for an approaching ion. It is thus possible to construct quadrupole systems whose upper mass limit is a factor of several hundred above the lower mass limit.

Figure 9:
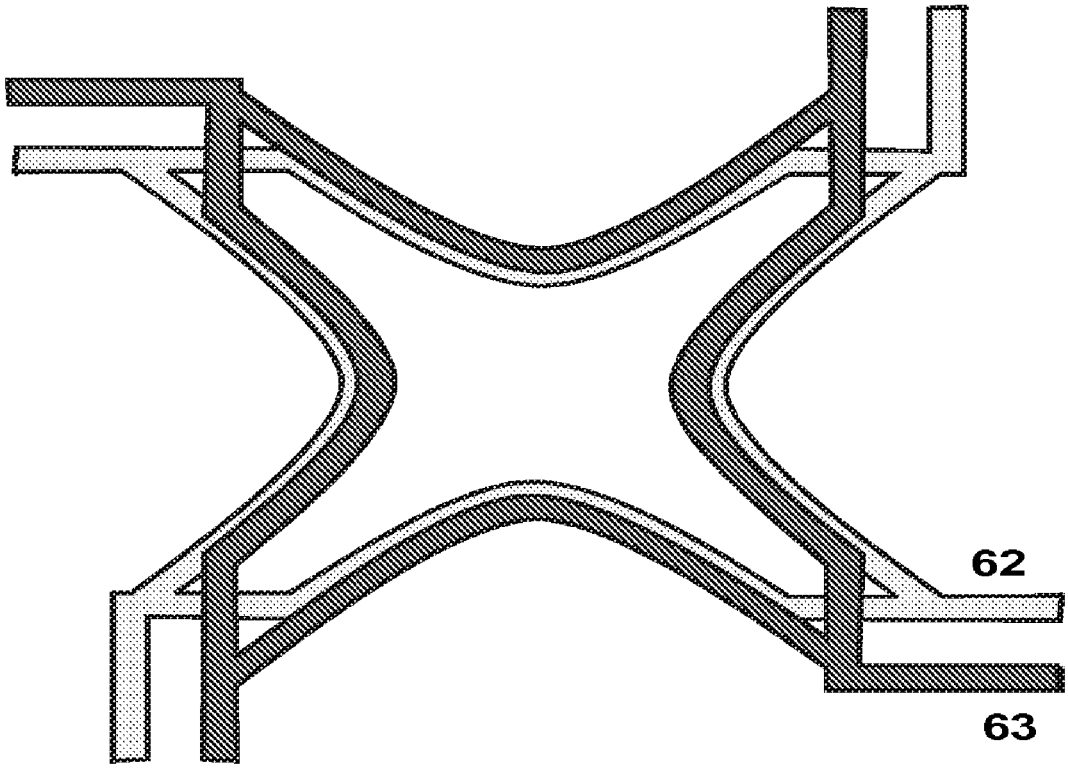
FIG. 9 illustrates two sheet electrodes which can be assembled to form a quadrupole ion guide which realizes this invention. The two sheet electrodes have an identical shape and are merely rotated through 90° with respect to each other. They can form two electrode arrays, each comprising sheet electrodes (62) and (63).
Figure 10:
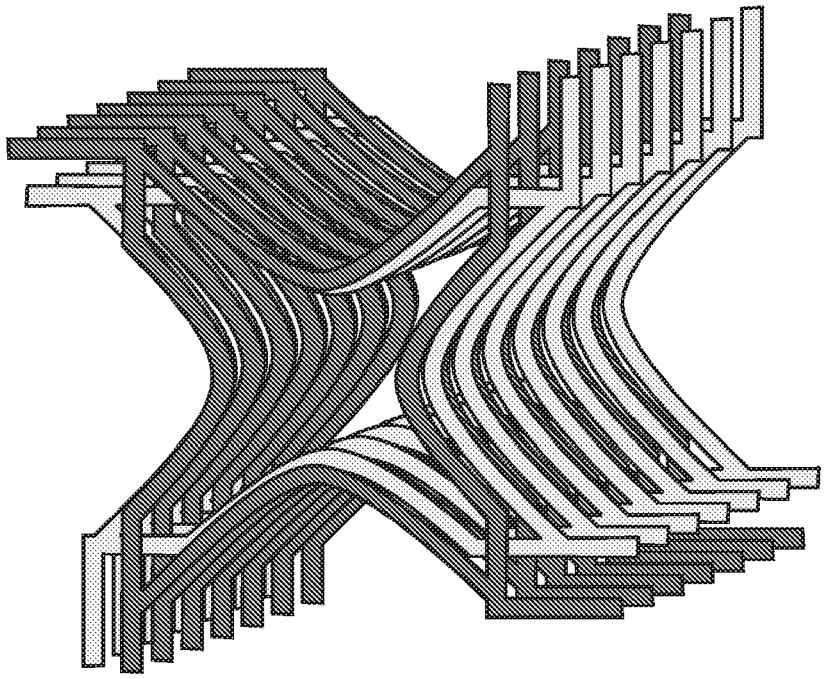
In FIG. 10 the sheet electrodes in FIG. 9 are assembled to form an ion guide. If the two pole electrode arrays are connected to two RF voltages of opposite polarity but the same amplitude, then an attenuated quadrupole field is generated in the interior because the electrodes of both electrode arrays (in a similar way to FIG. 8) extend to within different distances of the virtually generated surfaces.

In the same way, a technique whereby individual diaphragms are stacked can be used to produce a quadrupole field of the type shown in FIGS. 9 and 10. In the four inner "pole surfaces" of the quadrupole field the sheets of one electrode array stand back; if two RF voltages of opposite polarity but the same amplitude are applied, a weak quadrupole field with very low lower cut-off mass for storing ions is created while, in the near field in front of the "pole surfaces", heavy ions are also readily driven back.

It must be expressly emphasized here that a pole electrode system of this type made of either sheet-type or wire-shaped electrodes, as shown in the FIGS. 3, 4, 5, 9 and 10, is no longer a pole rod in the literal sense of the word.

The basic idea of the invention, namely the generation of near fields with greater inhomogeneity in front of the pole rods of a multipole field, preferably a quadrupole field, can also be achieved with solid pole rods. A very simple embodiment uses solid pole rods, as in the prior art, but here their surfaces are shaped to form a field of edges or tips with enclosed indentations. This can be achieved by milling channels or grooves, for example. In this case, as well, the alternating fields which are generated in the near field region in front of the edges or tips are more inhomogeneous than those which would be the case on smooth surfaces. It is thus possible to produce quadrupole systems whose upper mass limit is 30 to 40 times the lower mass threshold. This type of structure can also be constructed of pole rods which are not solid but comprise lamellae or other structural elements with edges or tips.

What is claimed is:

1. A multipole RF ion guide comprising:

a pole rod having a surface formed from grids of structural elements, wherein structural elements that are adjacent at the surface generate at the surface different electric fields that form an inhomogeneous field in the vicinity of the surface and a homogeneous far field away from the surface produced by an average of electric fields applied to the structural elements so that electric fields generated in a spatial region near to the surface are more inhomogeneous than electric fields generated by a pole rod having a continuous surface.

2. The multipole RF ion guide of claim 1 wherein the grids comprise one of a grid of one-dimensionally elongated punctiform structural elements and a grid of two-dimensionally elongated linear structural elements.

3. The multipole RF ion guide of claim 2, wherein neighboring structural elements of each pole rod belong to one of at least two different structural element ensembles, the structural elements of a structural element ensemble being electrically connected; and the different structural element ensembles being each separately fed with RF voltages.

4. The multipole RF ion guide of claim 3, wherein, for each pole rod, there are two structural element ensembles that form a bipolar grid.

5. The multipole RF ion of claim 4, wherein for one pole rod there is a non-vanishing far field which is formed from one of: two RF voltages with the same frequency but different amplitude, two RF voltages with a phase other than 180°, a mixture of RF voltages with different frequencies, structural elements of different sizes, structural elements at different distances from a virtual covering surface of the pole rod and a combination of the foregoing techniques.

6. The multipole ion guide of claim 1 further comprising means for applying different RF voltage to structural elements that are adjacent at the surface.

7. The multipole ion guide of claim 1 wherein the ion guide has an axis and structural elements that are adjacent at the surface are located at different distances from the axis.

* * * * *